US005829509A

United States Patent [19]

Crafton

[11] Patent Number: 5,829,509

[45] Date of Patent: Nov. 3, 1998

[54] INTEGRATED SYSTEM AND PROCESS FOR HEAT TREATING CASTINGS AND RECLAIMING SAND

[75] Inventor: Scott P. Crafton, Marietta, Ga.

[73] Assignee: Consolidated Engineering Co, Inc., Kennesaw, Ga.

[21] Appl. No.: 802,763

[22] Filed: Feb. 20, 1997

Related U.S. Application Data

[60] Provisional application No. 60/012,308, Feb. 23, 1996.

[51] Int. Cl.[6] ..... B22D 29/00; B02C 19/12

[52] U.S. Cl. ..... 164/5; 164/132; 164/404; 266/176

[58] Field of Search ..... 164/5, 132, 131, 164/404; 266/44, 176

[56] References Cited

FOREIGN PATENT DOCUMENTS 2458150 12/1975 Germany ..... 164/5
2137114 10/1984 United Kingdom ..... 164/5

*Primary Examiner*—Kuang Y. Lin

*Attorney, Agent, or Firm*—Isaf, Vaughan & Kerr

[57] ABSTRACT

Provided is a five-in-one process/integrated furnace system that (i) receives and heat treats a casting, (ii) removes sand core materials from the casting, (iii) actively reclaims sand from the sand core materials, (iv) substantially cools the reclaimed sand, and (v) removes fines from the reclaimed sand. The furnace system includes a heating chamber disposed above and contiguous with a cooling chamber. The heating chamber and cooling chamber are preferably constructed so that heat and gasses pass therebetween. The heating chamber is preferably in the general form of a heat treating furnace. The heating chamber receives and heat treats metal castings. During the heat treating process, sand core materials are dislodged from the castings and enter into a sand reclaiming region. A hot fluidized bed functions to reclaim sand from the sand core materials within the heating chamber. The sand reclaimed in the hot fluidized bed falls into a cool fluidized bed in the cooling chamber which is preferably directly beneath the heating chamber. Gasses are drawn from above the cool fluidized bed in a manner that removes fines and heat from the reclaimed sand. The fines are separated from the heated gasses, which are used in the hot fluidized bed.

49 Claims, 6 Drawing Sheets

INTEGRATED SYSTEM AND PROCESS FOR HEAT TREATING CASTINGS AND RECLAIMING SAND

CROSS-REFERENCE TO RELATED APPLICATION

This application claims the benefit of priority to U.S. Provisional Patent application Ser. No. 60/012,308, filed on Feb. 23, 1996.

BACKGROUND OF THE INVENTION

The present invention relates generally to the field of foundry processing, and more particularly to heat treating metal castings and reclaiming sand from sand cores and sand molds used in the manufacture of metal castings.

Many changes have been made in the field of heat treating metal castings and reclaiming sand from sand cores and sand molds used in the manufacture of metal castings. Examples of some recent disclosures which address the heat treating of castings, removal of sand cores, and further reclaiming of sand are found in U.S. Pat. Nos. 5,294,094, 5,354,038, and 5,423,370, each of which is expressly incorporated herein by reference, in their entirety. Those patents disclose a three-in-one process/integrated system that (i) receives and heat treats a casting, (ii) removes sand core/sand mold materials from the casting, and (iii) reclaims sand from the sand core/sand mold materials removed from the casting; the '094 and '038 patents embodying a convection furnace species and the '370 patent embodying a conduction furnace species. The sand core/sand mold materials (referred to hereafter as sand core materials) comprise sand that is held together by a binder material such as, but not limited to, a combustible organic resin binder.

Technology such as that disclosed in the above-mentioned patents are driven, for example, by competition; increasing costs of raw materials, energy, labor, and waste disposal; and environmental regulations. Those factors continue to mandate improvements in the field of heat treating and sand reclamation.

SUMMARY OF THE INVENTION

Briefly described, a preferred embodiment of the present invention comprises a unique five-in-one process/integrated system that (i) receives and heat treats a casting, (ii) removes sand core materials from the casting, (iii) actively reclaims sand from the sand core materials, (iv) substantially cools the reclaimed sand, and (v) removes fines from the reclaimed sand. In accordance with one embodiment of the present invention, the process/integrated system does not remove fines from the reclaimed sand, whereby a four-in-one process is provided. In accordance with still another alternate embodiment of the present invention, the process/integrated system does not heat treat, whereby a four-in-one (or three-in-one, if fines are not removed) process is provided. The various steps and subsystems of the aforementioned processes and systems are uniquely integrated and cooperate in a synergistic manner.

In accordance with the preferred embodiment of the present invention, a furnace system is provided that has a heating chamber (e.g., a furnace chamber) integrated and contiguous with a cooling chamber. The heating chamber and cooling chamber are preferably constructed so that heat and gasses pass therebetween. The heating chamber is preferably in the general form of a heat treating furnace, and includes, but is not limited to, both convection and conduction type furnaces. The heating chamber receives and heats and, preferably, heat treats, metal castings. During the heating process, sand core materials are dislodged from the castings and collected in a hot fluidized bed within the heating chamber. The hot fluidized bed functions to at least partially reclaim sand from the sand core materials. The heat associated with the heat treating and the heat associated with the hot fluidized bed are preferably both maintained within the heating chamber to maximize heating efficiency.

The sand reclaimed in the hot fluidized bed falls into the integrated cooling chamber. The cooling chamber of a first category of preferred embodiments (sometimes referred to herein as the "below-mounted" embodiments) is mounted below, and most preferably directly beneath, the heating chamber. In preferred ones of these below-mounted embodiments, at least some heat from the reclaimed sand within the cooling chamber rises to heat the heating chamber. In a second category of preferred embodiments (sometimes referred to herein as "side-mounted" embodiments), the cooling chamber is aligned beside the heating chamber.

Additionally, a blower that supplies fluidizing medium to the hot fluidized bed draws preheated air from above the cool fluidized bed, whereby the waste heat associated with the cool fluidized bed is recycled for use in the hot fluidized bed. Additionally, the blower that supplies the hot fluidized bed entrains fines with the heated air drawn from the cooling chamber. The fines are separated from the heated air, for example in a cyclone, before the heated air comes in contact with the blower.

In accordance with preferred embodiments of the present invention, the hot fluidized bed and the cool fluidized bed are disposed within a first trough and a second trough, respectively. Fluidizing assemblies substantially cover the bottoms of the troughs. Each of the troughs is equipped with a discharging device, such as a valve, that controls discharging from and the level of the respective fluidized bed. In accordance with exemplary preferred embodiments, a weir (or weirs) controls the discharging from and level of the fluidized beds. The materials within the fluidized beds flow naturally toward the discharge weir, and sand eclipsing the discharge weir of the heating chamber falls into the cooling chamber.

In exemplary below-mounted embodiments, the weir associated with the hot fluidized bed is a sand discharge weir that is in the form of an upright conduit. The sand discharge weir extends upward from the bottom of the first trough and communicates with an aperture in the bottom of the first trough. The reclaimed sand flows into the upper end of the sand discharge weir, passes through the sand discharge weir and thereby the aperture in the bottom of the first trough, and falls from the bottom of the sand discharge weir into the cool fluidized bed. In certain, alternate below-mounted embodiments, a baffle is disposed above the weir that seeks to ensure that sand core materials do not fall directly into the sand discharge weir without first being processed within the hot fluidized bed.

In exemplary side-mounted embodiments, the discharge weir comprises an opening and spillway formed within a common wall of the heating chamber and cooling chamber. Sand of the hot fluidized bed reaching the height of the opening exits the heating chamber and spills over the spillway to fall into the cool fluidized bed of the cooling chamber.

In accordance with exemplary embodiments of the present invention, sand discharge weirs are accessorized and/or modifiable to allow for variations in their effective height. The effective height of a sand discharge weir is varied to vary the dwell time of sand core materials within the hot fluidized bed. Variations in dwell time result in variations in the characteristics of the reclaimed sand. Additionally, in accordance with exemplary below-mounted embodiments of the present invention sand discharge weirs are equipped with angled extension conduits. An angled extension conduit extends from the base of a sand discharge weir and functions as a passive closure device.

It is, therefore, an object of the present invention to increase the efficiency of heat treating and sand reclamation processes.

Another object of the present invention is to provide an integrated system for accomplishing multiple casting, core and sand processing steps.

Yet another object of the present of the present invention is to provide an improved method and apparatus for removing sand core material from a casting and reclaiming sand from the sand core material.

Still another object of the present invention is to provide a single system that provides for substantially complete sand reclamation.

Still another object of the present invention is to utilize waste heat.

Still another object of the present invention is to provide control over the characteristics of reclaimed sand.

Still another object of the present invention is to provide a very efficient means for heat treating castings and reclaiming sand, whereby environmental impact is minimized.

Still another object of the present invention is to provide weirs with variable heights.

Other objects, features, and advantages of the present invention will become apparent upon reading and understanding this specification, when taken in conjunction with the accompanying drawings.

DETAILED DESCRIPTION OF THE PREFERRED EMBODIMENTS

Figure 1A:
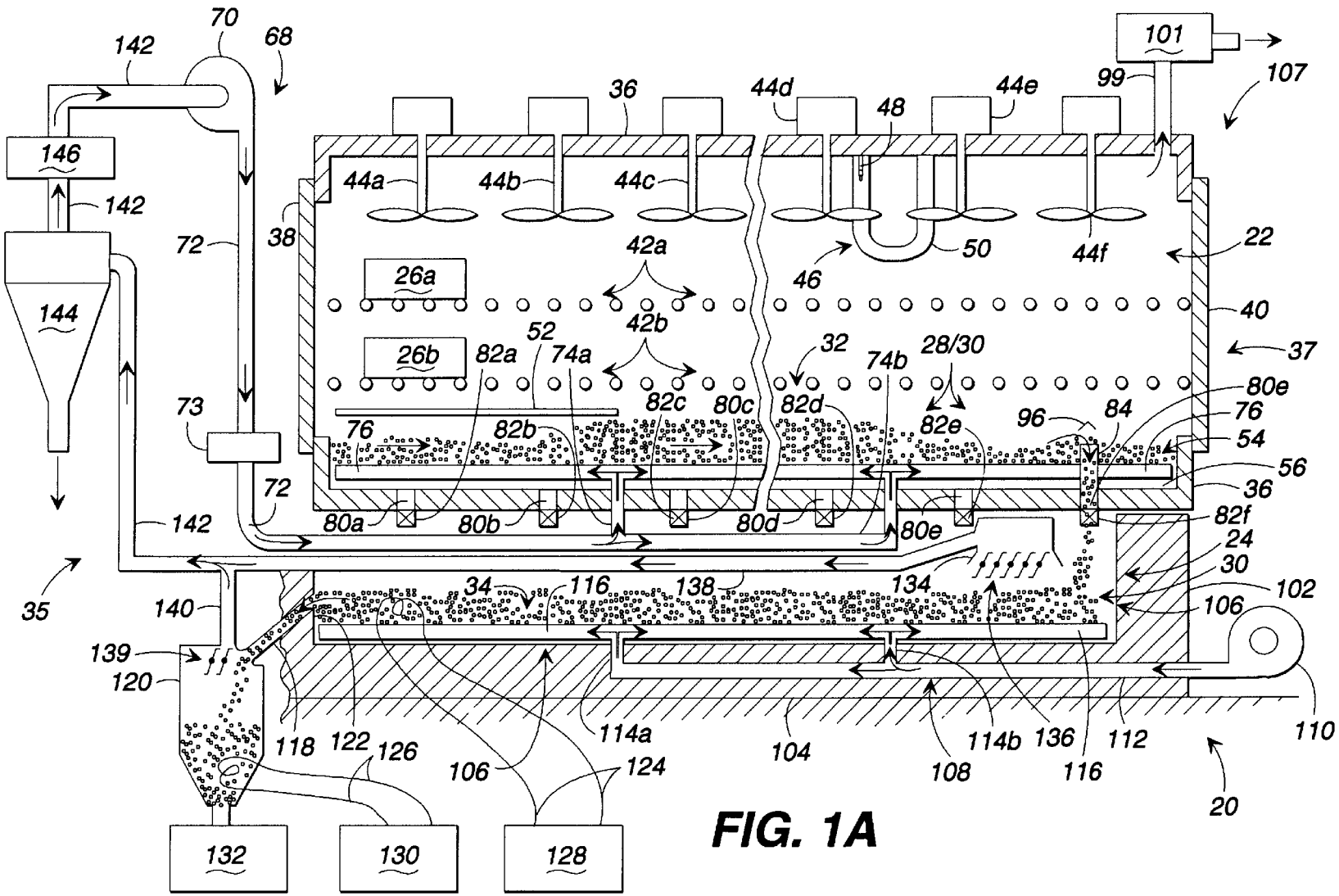
FIG. 1A is a schematic, side cut-away view of a furnace system in accordance with a first preferred embodiment of the present invention, depicting a first furnace type.
Figure 1B:
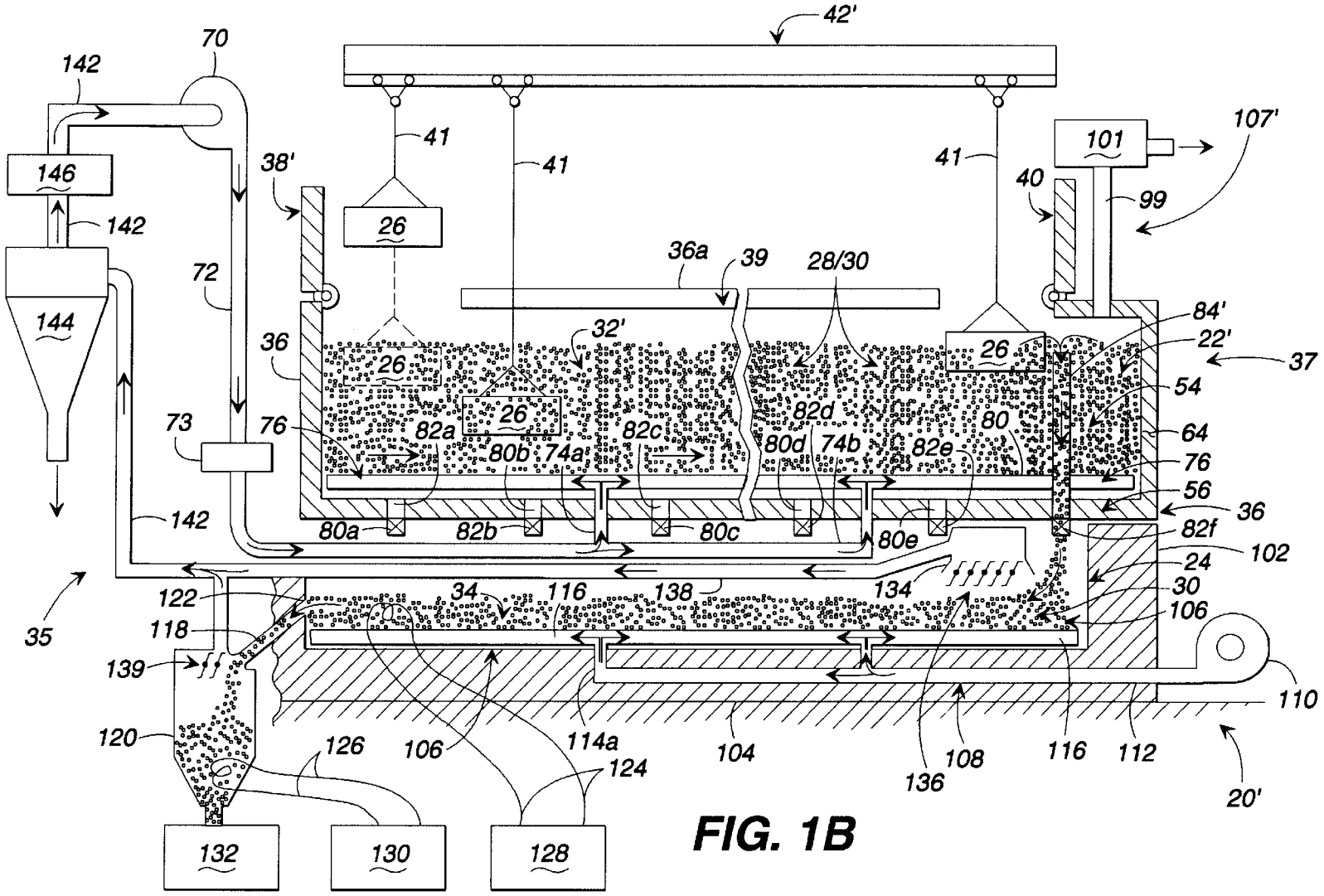
FIG. 1B is a schematic, side cut-away view of a furnace system in accordance with a second preferred embodiment of the present invention, depicting a second furnace type.

Referring to the drawings in which like numerals represent like components throughout the several views, FIGS. 1A and 1B show schematic, side cut-away views of a furnace system 20, 20' in accordance with alternate, preferred embodiments of the present invention. The furnace system 20, 20' includes a heating chamber 22, 22' (e.g., a heat treating furnace or furnace chamber) situated above and contiguous with a cooling chamber 24. The heating chamber 22,22' receives and heats castings and the cores therein (that are acceptably transported through the heating chamber 22, 22' in, for example, baskets 26*a,b*), dislodges sand core materials 28 from the castings, and actively reclaims sand from the sand core materials 28. In the most preferred embodiments, the heating chamber 22, 22' also heat treats the castings. The reclaiming is carried out, at least in part, in a hot fluidized bed 32, 32' that is preferably disposed within the heating chamber 22, 22'. The sand 30 (including the substantially reclaimed sand) falls from the heating chamber 22, 22' into the cooling chamber 24 through an outlet such as, but not limited to, a sand discharge weir 84. Once in the cooling chamber 24, the sand 30 is cooled in a cool fluidized bed 34. Additionally, fines are removed from the reclaimed sand 30 within the cooling chamber 24. Fines include particles such as, but not limited to, pieces of sand and any accompanying pieces of ash or binder material smaller than a predetermined size.

A front 35 and a rear 37 are defined. The heating chamber 22, 22' includes insulated walls 36, an insulated inlet door 38, 38' toward the front 35, and an insulated outlet door 40, 40' toward the rear 37. The walls 36 and doors 38, 38', 40, 40' bound and define the heated work chamber 22, 22'. In the embodiment shown in FIG. 1A, an upper conveyer assembly 42*a* (e.g., a roller hearth) and a lower conveyer assembly 42*b* (e.g., a roller hearth) extend through the heating chamber 22 from the inlet door 38 to the outlet door 40. In the embodiment of FIG. 1B: the basket 26 is supported by an overhead gondola conveyor assembly 42' which conveys the basket, with the casting therein, through the heating chamber 22'; the inlet door 38' and outlet door 40' are depicted as "tilting" doors to allow the introduction and removal of the basket/casting into and out of the heating chamber 22; and the upper wall 36*a* of the heating chamber is formed with a cable channel 39 to accommodate passage of the cable 41 from the overhead conveyor assembly. The conveyer assemblies 42*a*, 42*b*, 42' each receive and transport the castings (which are preferably disposed within baskets 26) through the heating chamber 22, 22' in a direction defined from the front 35 toward the rear 37. A casting quench facility (not shown) is preferably proximate to the outlet door 40 such that castings can be immediately quenched upon removal from the heating chamber 22, 22'. The baskets 26 are of open construction to permit sand core materials 28 dislodged from the castings to freely exit the baskets 26. Similarly, the conveyer assemblies 42 are constructed so that dislodged sand core materials 28 pass freely therethrough.

The embodiment depicted in FIG. 1A represents an embodiment wherein the heating chamber 22 is that of a convection type furnace, while the embodiment of FIG. 1B represents an embodiment in which the heating chamber 22' is characterized as a conduction furnace (such as a fluidized bed furnace.) Whether the heating chamber 22, 22' is that of a convection furnace or that of a conduction furnace, as represented by the drawing figures, or is a furnace of some other known or yet unknown type, the furnace system 20, 20' is provided with heaters (see heaters 46 in FIG. 1A; heaters not seen in FIG. 1B) which heat the atmosphere and/or conducting medium in the heating chamber 22, 22' to a processing temperature, in the preferred embodiment, sufficient to both heat treat castings and to combust (and which same temperature is sufficient, in regions lacking oxygen, to pyrolize) the binder that binds the sand of the core material 28, whereby core materials 28 are dislodged from and eventually exit the castings. For example, in preferred embodiments, the heating chamber 22, 22' is heated to a processing temperature in the range of 850 to 1400 degrees Fahrenheit (most preferably in the range of 850 to 1000 degrees Fahrenheit).

In the embodiment of FIG. 1A, a single heater 46 is schematically illustrated as including a burner 48 within a U-shaped tube 50. Preferably, a plurality of heaters 46 are employed within the heating chamber 22. The U-shaped tube 50 isolates the burner 48 from the atmosphere within the heating chamber 22. Alternatively, the burner 48 is exposed to the atmosphere within the heating chamber 22. A variety of different types of heaters, as would be understood by persons skilled in the art of the various types of furnaces, can be used to heat the heating chamber 22, 22' of the embodiments of FIGS. 1A and 1B.

The heaters are, preferably, capable of heating the atmosphere and/or conducting medium within the heating chamber 22, 22' to a processing temperature sufficient to simultaneously heat treat the castings and dislodge sand core materials 28 from cavities within the castings. The sand core materials 28 preferably comprise sand that is bound by a combustible binder material such as, but not limited to, an organic resin binder. Thus, in at least the preferred embodiments, heating chamber 22, 22' is heated to above the combustion temperature of the organic resin binder.

The heating chamber 22 of the embodiment of FIG. 1A can be characterized as a convection heating furnace including multiple zones through which the baskets 26 pass sequentially. For example, in FIG. 1 a different zone extends with and beneath each of the fans 44*a–f*. While only six fans 44 are shown in FIG. 1, heating chambers 22 with more or less than six fans 44 or zones are within the scope of this disclosure. The fans 44 function to circulate the atmosphere within the heating chamber 22. The fans 44*a–f* are preferably constructed to circulate the atmosphere in a manner that aids in the dislodging of core materials 28 from the castings subsequent to binder combustion (and/or pyrolysis). A plurality of screens 52, such as but not limited to one-quarter inch screens, are positioned beneath the conveyer assembly 42*b* in at least some of the earlier zones of the heating chamber 22. The screens 52 extend above the trough 54 (discussed below) so that the screens 52 capture substantially all of the clumps of sand core material 28 larger than one-quarter inch which are dislodged from the castings. The clumps of core material 28 collected on the screens 52 are suspended within and exposed to the heated and oxygen-rich airflow within the heating chamber 22 until a substantial portion of the binder associated with the clumps has burned off, at which time the clumps will disintegrate. When the clumps have disintegrated to a size smaller than one-quarter inch, the disintegrated clumps fall through the screens 52. The screens 52 are preferably situated in the earlier and middle zones because, in accordance with the preferred embodiment, that is where a majority of the core materials 28 are dislodged and fall from the castings. In accordance with some embodiments, the screens 52 extend for the entire length of the heating chamber 22.

In the embodiment of FIG. 1B, the hot fluidized bed 32 is that of a fluidized bed furnace in which the castings are immersed within the hot fluidized bed 32 during processing in the heating chamber 22'—e.g., during heat treating and/or core removal. In such an embodiment, the castings are, for example, placed in baskets 26 which are pulled along a conveyor assembly 42 through the hot fluidized bed 32 while fully immersed within the fluidized bed. The medium in the fluidized bed is, preferably, comprised substantially of foundry sand similar to and including that from which the sand cores are made and, from time to time, binder material.

Figure 2:
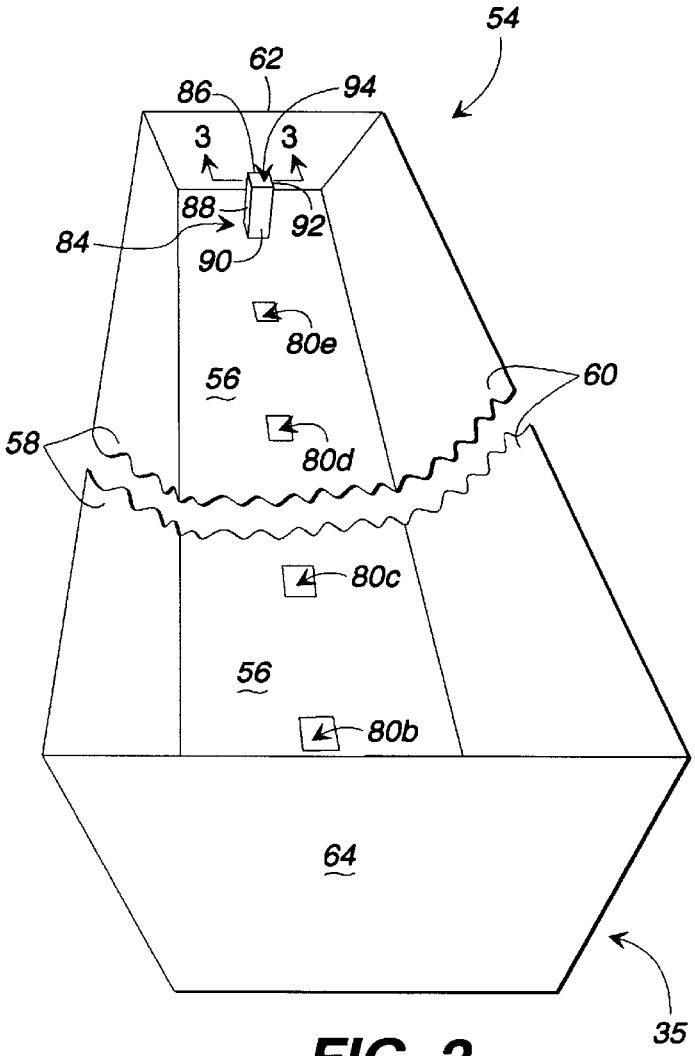
FIG. 2 is an isolated, schematic, perspective view of a collection trough, discharge openings, and sand discharge weir of the furnace system of FIGS. 1A and 1B.

A receptacle such as, but not limited to, a trough 54 is defined in the heating chamber 22, 22'. FIG. 2 is an isolated perspective view of the trough 54, discharge openings 80, and sand discharge weir 84 from the front 35 (also see FIGS. 1A, 1B) of the trough 54. Other components of the system 20, 20' that would otherwise be seen, including those within the heating chamber 22, 22' are, for clarity and ease of description, not shown in FIG. 2. The trough 54 includes a bottom 56 and side walls 58,60 extending upward from side edges of the bottom 56 in a divergent manner such that obtuse angles are defined between the side walls 58,60 and the bottom 56. Walls 62,64 extend upward from the other edges of the bottom 56. Referring additionally to FIGS. 1A and 1B, in accordance with the preferred embodiment, a fluidizing assembly 68 is closely associated with the bottom 56 of the trough 54. The fluidizing assembly 68 includes a blower 70 that forces a fluidizing medium through a conduit 72 that separates into headers 74*a,b* that feed a sub-header assembly 76. In accordance with the preferred embodiments, the sub-header assembly 76 includes a multiplicity of fluidizing tubes 78 (see FIGS. 3 and 5) (i.e., the sub-header assembly 76 is, for example, a sparger or perforated pipe distributor). A variety of conventional sub-header assemblies 76 are capable of being acceptably incorporated into the disclosed embodiments. In accordance with an alternate embodiment, a sub-header assembly 76 is not employed and the bottom 56 of the trough 54 functions as part of the fluidizing assembly 68. That is, the bottom 56 of the trough 54 is perforated and a fluidizing medium is forced through the perforations of the bottom 56.

In accordance with the preferred embodiment, the conduit 72 cooperates with a heater assembly 73 that heats the fluidizing medium to a temperature in excess of the temperature required to combust (which processing temperature is sufficient in the absence of oxygen, to pyrolize) the binder of the core material 28. This heating causes binder within the hot fluidized bed 32, 32' to combust (or, in an appropriate case, to pyrolize), thus freeing to a substantial degree the sand from the binder. In the preferred embodiment, the heater assembly 73 includes a high pressure gas burner (not shown). In accordance with alternate embodiments, the heater assembly 73 incorporates an electric heating element or other type of heater. In accordance with other alternate embodiments, a heater assembly 73 is not employed. In alternate embodiments without a heater assembly 73, the heating chamber 22, 22' is otherwise sufficiently heated such that binder materials are combusted (or pyrolized) within the fluidized bed 32, 32'.

Referring to both FIGS. 1A, 1B, and 2, a plurality of apertures or openings 80*a–f* are defined through the bottom of the trough 54. Referring to FIGS. 1A and 1B, valves 82*a–f* are situated beneath the openings 80*a–f*, respectively, and the valves 82*a–f* function to effectively open and close the openings 80*a–f*, respectively. The valves 82*a–f* are represented schematically in FIGS. 1A, 1B. The valves 82*a–f* are acceptably either manually operated or motor operated such that the valves 82*a–f* are capable of being operated remotely. The valves 82*a–e* are closed during normal operation and the valve 82*f* is open during normal operation, as discussed in greater detail below. The valves 82*a–e* may be opened in the case of an emergency, such as if a section of the sub-header assembly 76 becomes inoperative. The valves 82*a–f* are preferably manual gate or dump valves, or vibratory feeder valves, or stone-box type valves.

As mentioned previously, the sub-headers 76 of the fluidizer assembly 68 substantially cover the bottom 56 (FIG. 2) of the trough 54. However, the sub-headers 76 preferably do not cover the openings 80*a–f*, so the openings 80*a–f* are readily accessible from within the trough 54. That is, the upper sides of the openings 80*a–e* are in direct contact with the hot fluidized bed 32, 32'.

In accordance with the preferred embodiment, a sand discharge weir 84 is associated with the opening 80*f*. Substantially reclaimed sand 30 flows from the hot fluidized bed 32, 32' to the cooling chamber 24 through the sand discharge weir 84. Referring additionally to FIG. 2, the weir 84 extends upward from the opening 80*f* and includes, in the disclosed embodiment, walls 86, 88, 90, 92 that are joined at their edges such that the weir 84 is in the form of an elongated conduit that is generally in the shape of a square in a top plan view thereof. The walls 86, 88, 90, 92 bound a passage 94 that is open at the upper end of the weir 84 within the trough 54. At the lower end of the weir 84 the passage 94 is open to the cooling chamber 24 when the valve 82*f* is open.

In accordance with other embodiments of the present invention, a sand discharge weir 84 is not incorporated into the present invention. When the weir 84 is not incorporated, the valve 82*f* or some other device (not shown) is operative to maintain the level of core materials 28 within the trough 54 that is necessary to maintain proper operation of the hot fluidized bed 32, 32'. When the valve 82*f* maintains the level, the valve 82*f* is responsive to measurements that are indicative of the volume of the hot fluidized bed 32, 32'; discharging is established when a first volume of the bed 32, 32' is detected, and discharging is terminated at a second volume of the bed 32, 32' is detected. The volume can be quantified by sensing the height of the hot fluidized bed 32, 32' or sensing the pressure within the conduit 72, headers 74, or sub-header assemblies 76 of the fluidizing assembly 68.

As depicted in FIG. 1A, an inverted V-shaped baffle 96 is positioned above the upper opening to the passage 94 of the weir 84 in the system 20 of that Fig. The baffle 96 is preferably positioned sufficiently above the weir 84 so that the baffle 96 does not interfere with the flow of sand 30 from the hot fluidized bed 32 into the passage 94 of the weir 84. The baffle 96 is positioned above the weir 84 and is broad enough such that the baffle 96 substantially keeps any sand core materials 28 from falling directly into the weir 84 castings 26 passing above. That is, any sand core materials 28 that fall from castings above the weir 84 are deflected by the baffle 96 such that they fall into the hot fluidized bed 32.

The heating chamber 22, 22' controllably vents to the atmosphere through an exhaust conduit 99 that communicates with an incinerator 101.

Figure 3:
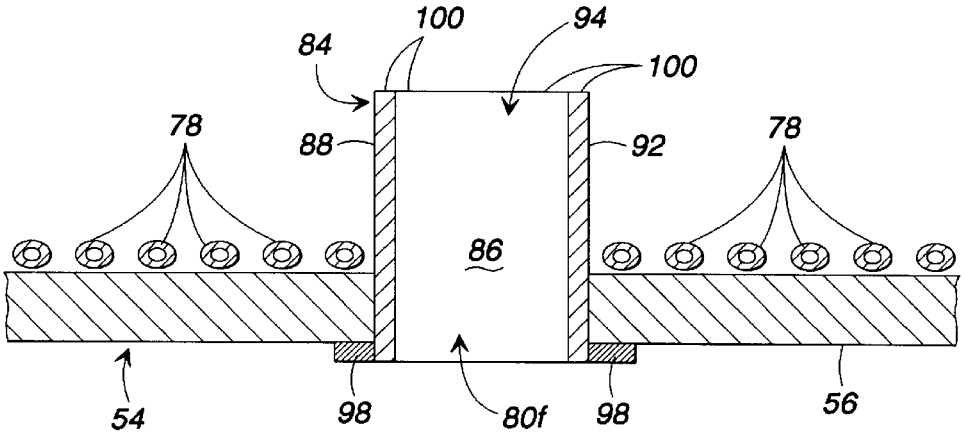
FIG. 3 is a schematic, cut-away, cross-sectional view of a portion of the furnace system of Figs. 1A, 1B taken along line 3—3 of FIG. 2. The sand discharge weir is central to FIG. 3. Additionally, substantial portions of the furnace system have been cut-away, and cross-sectioned fluidizing tubes are shown.

FIG. 3 is a somewhat isolated, schematic, cross-sectional view of the furnace system 20, 20' (FIGS. 1A, 1B) taken along line 3—3 of FIG. 2. The valve 82*f* is not shown and substantial portions of the furnace system 20, 20', including portions of the trough 54 and portions of the sub-headers 76, are cut away in FIG. 3. Additionally, in FIG. 3, portions of the sub-headers 76 are depicted in the form of fluidizing tubes 78, only several of which are specifically identified in FIG. 3. The fluidizing tubes 78 are cross-sectioned transverse to their length in FIG. 3. The fluidizing tubes 78 preferably define a plurality of apertures (not shown) through the sidewalls thereof. The fluidizing medium passes through the apertures in the side walls of the fluidizing tubes 78. The apertures are preferably oriented downward in a manner that seeks to keep sand 30 and sand core materials 28 from entering the fluidizing tubes 78.

The walls 86,88,90,92 (also see FIG. 2) of the weir 84 preferably each extend to the same height above the bottom 56 of the trough 54. Therefore, the upper edges of the walls 86,88,90,92 together function as a weir edge 100 over which the sand 30 (FIG. 1) flows into the passage 94 to pass through the weir 84. The weir edge 100 and the opening defined by the weir edge 100 preferably define a generally horizontal plane. As seen in FIG. 3, the lower edges of the walls 86,88,90,92 (also see FIG. 2) of the weir 84 preferably extend through the bottom 56 of the trough 54. A flange 98 preferably bounds the opening 80*f* and is attached to the bottom of the trough 54, for example by welding. The lower edges of the weir 84 are preferably attached to the flange 98, for example by welding.

The height of the weir 84 will impact the depth of the fluidized bed 32, and, as will be understood, the discharge weir height of the embodiment of FIG. 1B will typically be higher relative to the trough walls 58–64 then is the weir 84 of the embodiment of FIG. 1A, in order that the bed 32' might engulf the castings therein.

Figure 4:
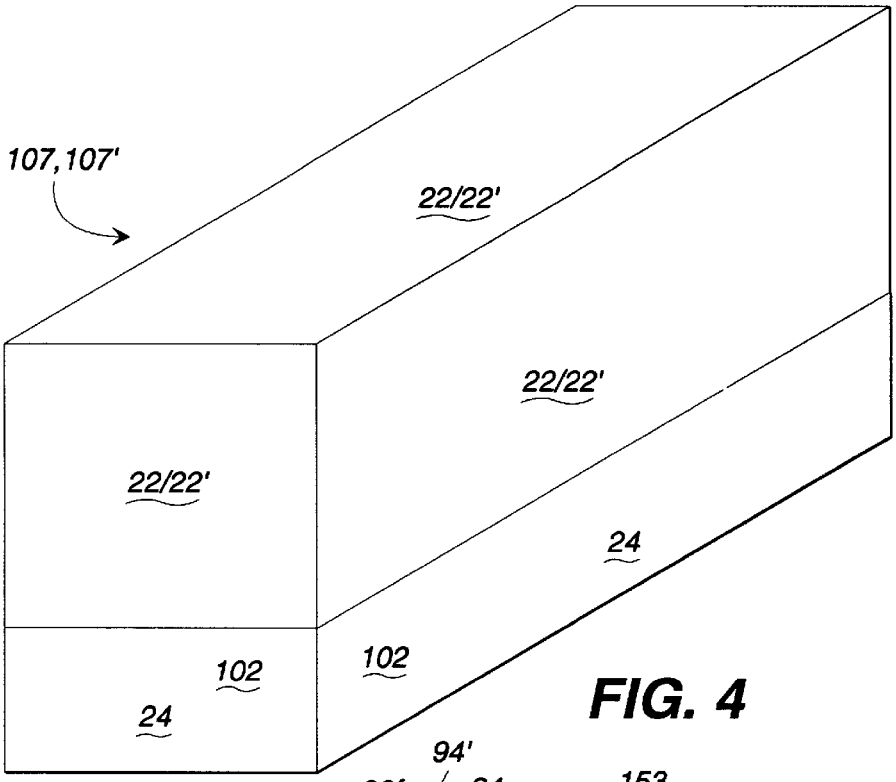
FIG. 4 is an isolated, schematic view depicting the preferred stacked and contiguous relationship between a heating chamber and a cooling chamber of the furnace system of FIGS. 1A and 1B.

Referring back to FIGS. 1A, 1B, the sand 30 that flows through the weir 84 falls into the cooling chamber 24 and onto the cool fluidized bed 34. The cooling chamber 24 is preferably immediately beneath and contiguous with the heating chamber 22, 22' such that heat from the sand 30 that has fallen into the cooling chamber 24 rises naturally from the cooling chamber 24 to the heating chamber 22, 22' to aid in the heating of the heating chamber. The cooling chamber 24 is preferably generally enclosed by a plurality of partitions 102 (only one of which is shown in FIGS. 1A, 1B, but also see FIG. 4) that span between the floor 104 and the lower periphery of the heating chamber 22, 22'. A majority of the partitions 102 are preferably readily removable from the cooling chamber 24 so that the components within the cooling chamber 24 are capable of being readily accessed and serviced. It is preferable for the partitions 102 not to substantially enclose the cooling chamber 24 such that ambient air flows substantially freely into the cooling chamber 24. Alternately, the partitions 102 substantially enclose the cooling chamber 24, and in such a configuration mechanisms in addition to those discussed below are preferably provided to remove fines and dust from the cooling chamber 24. In accordance with an alternate embodiment, the cooling chamber 24 is preferably not substantially bounded by partitions 102 (FIGS. 1A, 1B, and 4). The lack of partitions 102 is intended to maximize cooling airflow through and accessibility to the cooling chamber 24.

In accordance with the preferred embodiments the furnace system 20, 20' comprises a single large work chamber 107, 107' that includes both the heating chamber 22, 22' and the cooling chamber 24 in a stacked arrangement. FIG. 4 is an isolated, schematic, end, side, perspective view of the work chamber 107, 107' that schematically depicts the preferable stacked and contiguous relationship between the heating chamber 22, 22' and the cooling chamber 24. A view of the work chamber 107, 107' from the end and side opposite from that depicted in FIG. 4 would be a mirror image of FIG. 4.

Central to the cooling chamber 24 is an elongated receptacle such as, but not limited to, a trough 106 that is elevated above the floor 104. The trough 106 extends from beneath the weir 84 to beneath the front 35 of the heating chamber 22, 22'. A fluidizing assembly 108 is closely associated with the bottom of the trough 106. The fluidizing assembly 108 includes a blower 110 that preferably takes suction from a source of relatively cool fluidizing medium (e.g., ambient air). The blower forces the fluidizing medium through a conduit 112 that separates into headers 114*a,b* that feed a sub-header assembly 116. In accordance with the preferred embodiments, the sub-header assembly 116 includes a multiplicity of fluidizing tubes similar to the fluidizing tubes 78 (FIGS. 3 and 5) discussed above (i.e., the sub-header assembly 116 is preferably a sparger or perforated pipe distributor). A variety of conventional sub-header assemblies 116 are acceptable. In accordance with an alternate embodiment, a sub-header assembly is not employed and the bottom of the trough 106 functions as part of the fluidizing assembly 108. That is, the bottom of the trough 106 is perforated and a fluidizing medium is forced through the perforations in the bottom of the trough 106. Alternate flow paths are, within the scope of the present invention, definable within the trough 106 of the cooling chamber 24 (and, for that matter, also within the trough 54 of the heating chamber 22)—for example, a serpentine path defined within the trough whereby the sand follows in such a path so as to increase the duration within the chamber. (See, for example, FIG. 7).

An outlet duct 118 communicates between the end of the trough 106 and a hopper 120. The inlet to the outlet duct 118 is elevated above the bottom of the trough 106 such that a weir 122 is defined. Sand 30 flows over the weir 122 to enter the outlet duct 118 and thereby exit the cool fluidized bed 34 and the cooling chamber 24. The hopper 120 discharges the cooled sand 30 to a device such as, but not limited to, a pneumatic transporter 132. The transporter 132 preferably transports the sand 30 to a core making facility where the sand is used in the manufacture of sand cores. Cooling of the sand 30 is preferably enhanced by cooling loops 124,126 (e.g., piping systems) that extend into the cool fluidized bed 34 and hopper 120, respectively. The cooling loops 124,126 preferably circulate a cooling medium, such as cool water, from sources of cooling medium 128,130 (e.g. cooling towers).

In accordance with other embodiments of the present invention, a discharge weir 122 is not incorporated into the present invention. When the weir 122 is not incorporated, a discharge valve (not shown) or some other device (not shown) is operative to maintain the level of sand 30 within the trough 106 that is necessary for proper operation of the cool fluidized bed 34. When a discharge valve maintains the level within the trough 106, the discharge valve is responsive to measurements that are indicative of the volume of the cool fluidized bed 34; discharging is established when a first volume in the bed 34 is detected, and discharging is terminated when a second volume in the bed 34 is detected. The volume can be quantified by sensing the height of the cool fluidized bed 34 or sensing the pressure within the conduit 112, headers 114, or sub-header assemblies 116 of the fluidizing assembly 108.

In accordance with the preferred embodiments, the sand 30 is substantially classified before it is transported away from the furnace system 20, 20'. In accordance with the preferred embodiments, fines are initially drawn from the sand 30 into an intake assembly or ventilating hood 134, and through a conduit 138. Adjustable louvers 136 (e.g., slats) are preferably arranged across the entrance to the hood 134 in a manner that seeks to deflect any sand 30 that is entrained with the fines being drawn into the hood 134. Fines are also preferably drawn from the hopper 120 into a conduit 140 communicating with the upper internals of the hopper 120. A plurality of adjustable louvers 139 (e.g., slats) are preferably arranged across the entrance to the conduit 140 in a manner that seeks to deflect any sand 30 that is entrained with the fines being drawn into the conduit 140. A vacuum within the conduit 142 draws fines into the hood 134 and conduit 140. The vacuum within the conduit 142 is generated by the blower 70 of the fluidizing assembly 68. It is important to note that not only fines drawn into the conduit 142. Hot fluidizing medium (e.g., air) is drawn into the conduit 142 from the ventilating hood 134 and the hopper 120. The fines are separated from the hot fluidizing medium before the hot fluidizing medium is drawn into the blower 70. In accordance with the preferred embodiments, the device that primarily separates the fines from the fluidizing medium is a cyclone 144 that centrifugally separates fines from the fluidizing medium. A filter 146 also aids in the separation of fines from the fluidizing medium.

In alternate designs of the furnace system 20 of FIG. 1A, the baskets 26 are initially placed upon the upper conveyer assembly 42*a* at the inlet door 38. The baskets 26 move along the upper conveyer assembly 42*a* deep into the heating chamber 22. Then, the baskets 26 are lowered to the lower conveyer assembly 42*b* and are conveyed back to the inlet door 38 for removal from the heating chamber 22. In that alternate embodiment, the casting quench facility (not shown) is proximate to the inlet door 38 such that castings can be immediately quenched upon removal from the heating chamber 22. In that alternate embodiment, it would be preferable for the hot fluidized bed 32 to flow toward the front 35 of the furnace system 20 and the cool fluidized bed 34 to flow toward the rear of the furnace system 20 so that the pneumatic transporter 132 is maintained at the opposite end of the furnace system 20 from the casting quenching facility. In other designs, only a single conveyor assembly 42 is employed. In still other designs, the furnace system 20, 20' is a small batch furnace that does not utilize conveyor assemblies 42.

Figure 5:
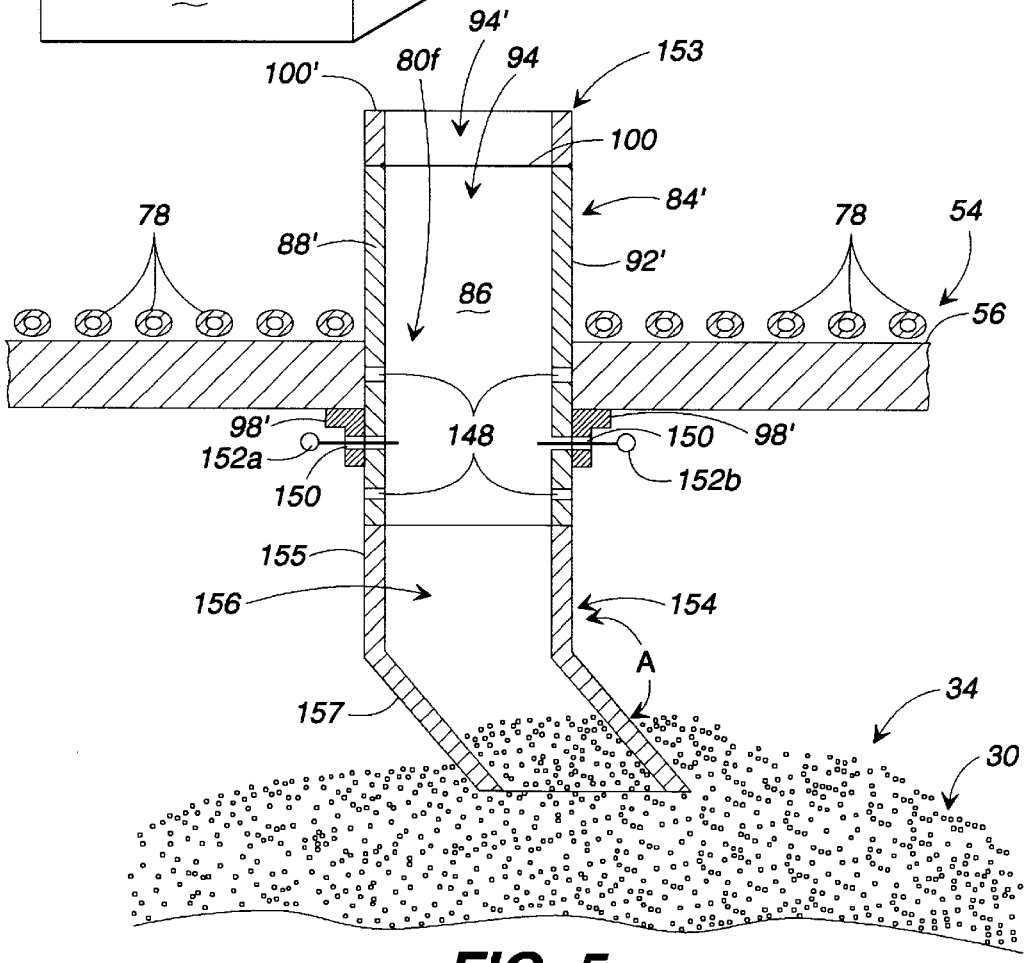
FIG. 5 is similar to FIG. 3, but depicts an alternate and accessorized sand discharge weir in accordance with an exemplary embodiment of the present invention.

FIG. 5 is view similar to that of FIG. 3 that shows a cross-sectioned adjustable weir 84' and other weir accessories, in accordance with another exemplary embodiment. The weir 84' is incorporated into the furnace system 20, 20' (FIGS. 1A, 1B) in place of the weir 84 (FIGS. 1A, 1B). The weir 84' itself is identical to the weir 84 of FIGS. 1A, 1B, and 2, except that the weir 84' is not welded to the flange 98', and the weir 84' includes a plurality of apertures 148 through the walls 88',92' thereof. The flange 98' that bounds the opening 80*f* also defines apertures 150 therethrough. The height of the weir edge 100 above the bottom 56 is adjusted by removing pins 152*a,b* from the apertures 148,150. Once the pins 152*a,b* are removed, the adjustable weir 84' is capable of being moved vertically further into or out of the trough 54 to change the effective height of the weir edge 100 above the bottom 56 of the trough 54. Once the weir 84' is moved vertically to obtain the desired height, the weir 84' is moved slightly further if necessary to align apertures 150,148. Once apertures 150,148 are properly aligned, for example as depicted in FIG. 5, the pins 152*a,b* are inserted into the aligned apertures 150,148 as depicted in FIG. 5. As depicted in FIG. 5, three different heights can be maintained by virtue of the fact that three pairs of apertures 148 are defined by the weir 84. Various numbers of paired apertures 148 are within the scope of this disclosure. When the weir 84' is used in place of the weir 84 (FIG. 1), changing the height of the weir 84' will change the volume of the hot fluidized bed 32, which will change the amount of time that the collected portions of core materials 28 are subjected to fluidizing, which will change the characteristics of the reclaimed sand.

The effective height of either weir 84' or weir 84 (FIGS. 1–3) can, also, be varied by a weir extension 153. As depicted in FIG. 5, a weir extension 153 is mounted to the upper end of the weir 84'. The mounting is acceptably facilitated by welding. The weir extension 153 in isolation is acceptably identical to the weir 84 (FIGS. 1–3) of the first embodiment in isolation, except that the depicted weir extension 153 defines a shorter length. Weir extensions 153 of various lengths are within the scope of this disclosure. The weir extension 153 is a conduit that is square in an isolated top or bottom plan view thereof. The weir extension 153 includes four walls that bound and define a passage 94' that is open at the top and bottom of the weir extension 153. The walls of the weir extension 153 further define an effective weir edge 100' over which sand 30 flows into the passage 94' of the weir extension 153. When the weir extension 153 is mounted to the weir 84', the passage 94' of the weir extension 153 communicates directly with the passage 94 of the weir 84'.

In FIG. 5, the weir 84' is additionally fitted with a discharge conduit 154 that depends from the bottom of the weir 84'. As discussed in greater detail below, the discharge conduit 154 functions as an angled extension that extends from the base of the weir 84' and functions as a passive closure device. The discharge conduit 154 includes an elongated upper section 155 and an elongated lower section 157, each of which has generally square cross-sections when cross-sectioned perpendicularly to its length. The discharge conduit 154 defines a passage 156 that is bound by the walls of the discharge conduit 154. The passage 156 is open at the opposite ends of the discharge conduit 154 such that sand 30 passes through the discharge conduit 154. The upper section 155 of the discharge conduit 154 is generally a straight, vertical, lower extension to the weir 84'. The lower section 157 of the discharge conduit 154 is generally straight, and an angle "A" is preferably defined between the upper section 155 and lower section 157. The angling of the discharge conduit 154 enhances the operation of the discharge conduit 154. The discharge conduit 154, and particularly the lower section 157 of the discharge conduit 154, functions as a passive closure assembly. That is, if for some reason the cool fluidized bed 34 (also see FIGS. 1A, 1B) becomes over filled, sand 30 will tend to accumulate in the passage 156 in a manner that seeks to obstruct passage through the weir 84'. Additionally, in accordance with an alternate embodiment (not shown), the system 107, 107' (FIGS. 1A, 1B) is constructed such that the lower section 157 of the discharge conduit 154 is normally just slightly extending into the cool fluidized bed 34 such that sand 30 continues to flow though the weir 84' and the discharge conduit 154, but such that the atmosphere within the heating chamber 22, 22' (FIGS. 1A, 1B) and the cooling chamber 24 (FIGS. 1A, 1B) do not freely pass through the weir 84' during operation of the system 107. Referring additionally to FIGS. 1A, 1B, the discharge conduit 154 can be installed in place of the valve **82*f* or in series with, and preferably downstream of, the valve 82*f***.

OPERATION

Referring to FIGS. 1A and 1B, in accordance with the most preferred embodiments, the furnace system 20, 20' (i) receives and heat treats castings, (ii) removes sand core materials 28 from the castings, (iii) actively reclaims sand 30 from the sand core materials 28, (iv) substantially cools the reclaimed sand 30, and (v) removes fines from the reclaimed sand 30. Initially, metal castings such as, but not limited to, aluminum castings are placed into baskets 26. The castings preferably have at least some sand core materials 28 attached thereto. The sand core materials 28 preferably comprise sand bound by a binder material such as, but not limited to, a combustible organic resin binder. Most preferably the castings are aluminum castings that define cavities and have substantially intact sand cores (comprising sand and combustible binder) therein. In accordance with an alternate embodiment, sand core materials 28 are introduced into the heating chamber 22 separate from the castings.

The inlet door 38, 38' is temporarily opened and a basket 26 is placed upon one of the conveyer assemblies 42. Alternatively the castings may be placed directly upon the conveyer assemblies 42. As the castings are conveyed through the heating chamber 22, 22' at least a portion of the binder of the sand cores is involved in a chemical reaction (e.g., combustion or pyrolysis) resulting in sand core materials 28 being dislodged from and eventually exiting the castings. The castings are preferably maintained within the heating chamber 22, 22' for a sufficient period such that the castings are heat treated for at least several hours and the sand cores are substantially totally removed from the castings. In the preferred embodiments, the mentioned chemical reaction is accomplished as combustion as the relevant temperatures are raised to a level sufficient to combust the binder material and sufficient oxygen is made available (as air or otherwise) to support combustion. Oxygen is preferably supplied with the fluidizing medium (i.e. air) into the bottom of the heating chamber 22, 22' by way of the fluidizing assembly 68. Oxygen can also be introduced by other means such as by exposing the burner 48 of FIG. 1A to the atmosphere within the heating chamber 22 and by providing an excess amount of oxygen to the burner 48.

The sand core materials 28 that enter the hot fluidized bed 32, 32' are suspended and agitated within the heated (and, preferably, oxygenated) environment of the hot fluidized bed 32, 32' such that chemical reaction (e.g., combustion, in the preferred, oxygenated environment) is promoted involving the binder of the core material 28, which reaction results in binder separating from sand of the core material, sand originally making up part of the sand cores is reclaimed such that it is substantially ready for reuse. In addition to being heated by the heater assembly 73, the hot fluidized bed 32 of FIG. 1A is heated due to its proximity to the heater 46 and the heated environment within the heating chamber 22. Also, the sand 30 within the cool fluidized bed 34 is at least initially very hot, and heat from the hot sand 30 rises naturally from the cool fluidized bed 34 to heat the heating chamber 22, 22' and the hot fluidized bed 32, 32'. For example, it is believed that at least some hot air may flow from the cooling chamber 24 to the heating chamber 22, 22' through the weir 84. Alternately, the system 20 is provided with additional open tubes (not shown) whose openings extend above the top of the discharge weir 84 (see FIGS. 1A and 1B), which open tubes communicate between the heating chamber 22, 22' and the hottest zones of the cooling chamber 22 drawing hot air from the hottest zones of the cooling chamber into the heating chamber. Heat is also transferred between the hot fluidized bed 32, 32' and the cool fluidized bed 34 by way of forced convection. That is, the blower 70 draws fluidizing gases (e.g., air) that is preheated by the sand 30 from the ventilation hood 134 and the hopper 120. It is believed that the preheated fluidizing gases drawn into the ventilation hood 134 will be approximately 100 to 120 degrees Celsius. Due to the fact that the sand 30 within the hopper 120 may be substantially cooled, it may be preferable for the blower 70 to draw fluidizing gases solely from the ventilating hood 134 or other substantially heated locations within the heating chamber 22, 22'. Fines entrained with the fluidizing gases drawn from the ventilation hood 134 and hopper 120 (if tied into the intake side of the fluidizing assembly 68) are preferably separated from the fluidizing gases in the cyclone 144. The fines fall from the base of the cyclone 144 and are then collected for disposal.

In accordance with the preferred embodiments, the sand 30 within the hot fluidized bed 32 flows toward the sand discharge weir 84 due to the action of the fluidizing assembly 68 and the fact that the weir 84 is an outlet from the heating chamber 22, 22'. Additionally, the trough 54 (or its bottom 56) may be inclined slightly to enhance the flow of sand 30 toward the weir 84. During normal operations the valve 82*f* is open and the sand flows through the weir 84 and falls into the cool fluidized bed 34. The valve 82*f* may be closed automatically if such closure would aid in minimizing the negative impacts of certain types of equipment malfunctions. Similarly, the valve 82*f* may be operated for maintenance purposes. During normal operations the valves 82*a–e* preferably remain closed. However, those valves 82*a–e* may be opened in case of emergencies such as if the weir 84 becomes blocked. Opening of the valves 82*a–e* may be triggered by sensors that sense high levels of sand core materials 28 within the trough 54. Such sensors are acceptably mounted within the trough 54. The valves 82*a–e* may also be opened for maintenance purposes.

The sand 30 that has fallen into the cool fluidized bed 34 is cooled by virtue of the fact that it is fluidized by a fluidizing gas such as ambient air. The sand 30 within the cool fluidized bed 34 flows toward and over the weir 122 due to the action of the cool fluidized bed 34 and the presence of the outlet duct 118. This flow is acceptably enhanced by slightly elevating the rear 37 end of the trough 106. The sand 30 flows through the outlet duct 118 to the hopper 120 and is later transported away from the hopper 120 by the pneumatic transporter 132. The cooling of the sand 30 is preferably enhanced by the cooling loops 124,126.

Figure 6:
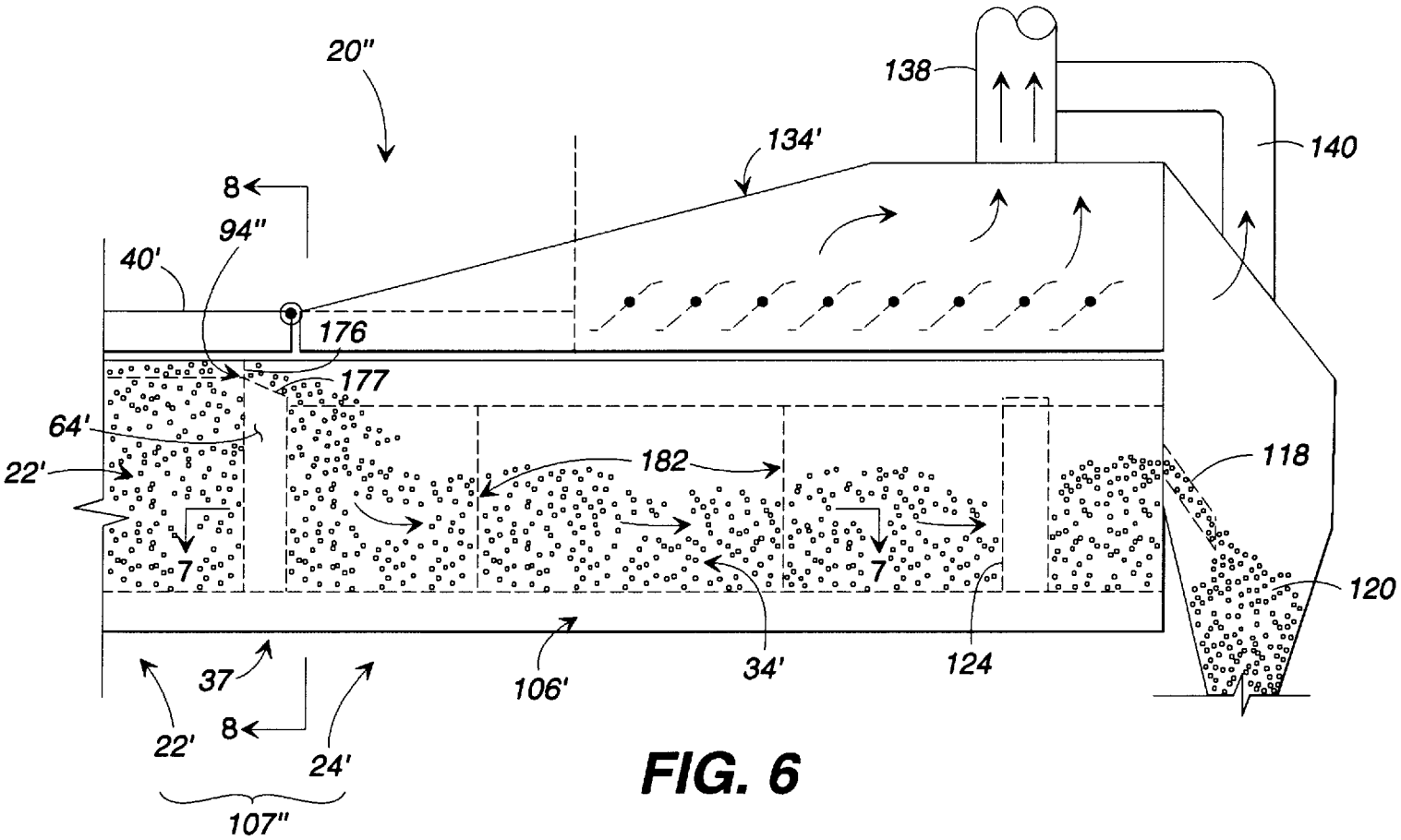
FIG. 6 is a schematic, cut-away side view of a furnace system in accordance with the present invention, depicting a side-mounted cooling chamber embodiment.
Figure 7:
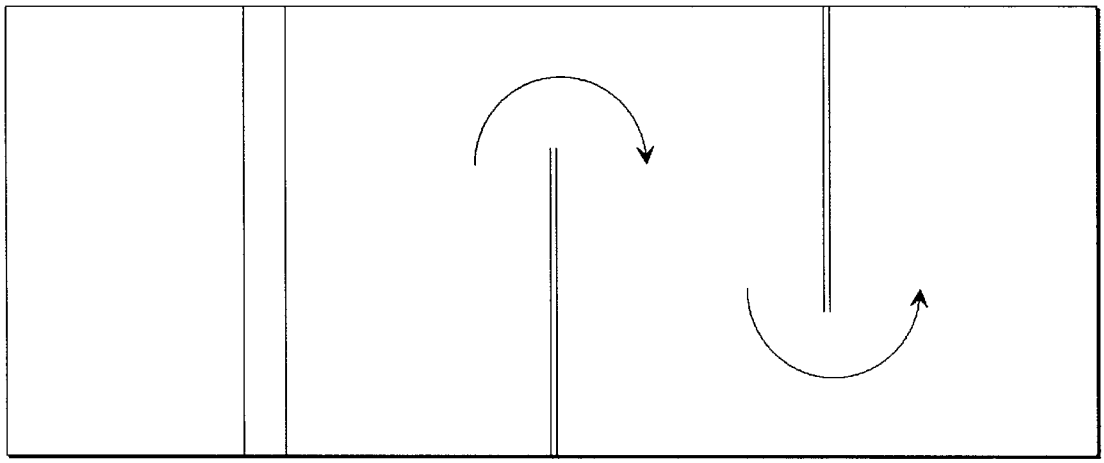
FIG. 7 is an isolated, schematic, top plan view of the cooling chamber of FIG. 6, taken along line 7—7 of FIG. 6.
Figure 8:
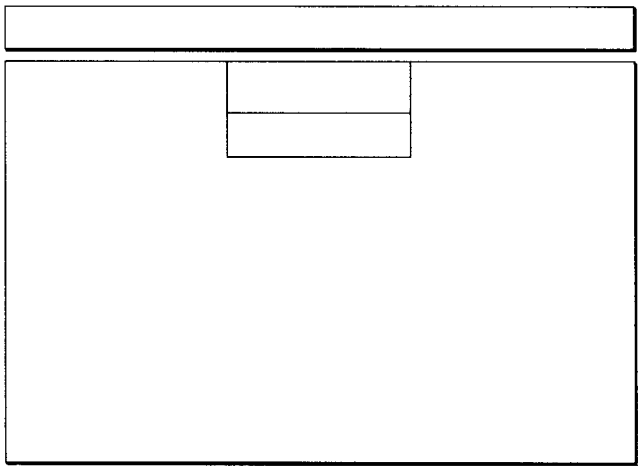
FIG. 8 is a schematic, cross-sectional end view taken along line 8—8 of FIG. 6.

With reference to FIG. 6, an exemplary, side-mounted embodiment of the cooling chamber 24' is schematically shown as part of the furnace system 20", integrated and contiguous with the heating chamber 22' of a convection-type furnace of the type depicted in FIG. 1B. The heating chamber 22' is only partially shown in FIG. 6, but can be understood by reference to FIG. 1B. Shown in FIG. 6 is the rear end 37 of the heating chamber 22' and the tilting outlet door 40' associated with the heating chamber. The rear end wall 64' of the heating chamber 22', in this embodiment, serves as a common wall 64' between the heating chamber and the cooling chamber 24'. Formed through the common wall 64' is a passage 94" which functions as a discharge weir communicating from the heating chamber 22' through the common wall to the cooling chamber 24'. The passage 94" is seen in this embodiment as being defined by an opening 176 and spillway 177. (See, also, FIG. 8). The passage 94" is positioned high enough within the common wall 64' to define the hot fluidized bed 32' at a height sufficient to engulf the castings therein. The area of the opening 176 is defined so as to meet the outflow requirements of the user, taking into consideration the volume of the hot fluidized bed 32' and the desired duration for the sand 30 within the heating chamber. In alternate embodiments, the area of the passage opening 176 (and related spillway volume), as well as, alternately, the exact height of the passage 94" along the common wall 64' are varied and/or variable to accommodate varying outflow and duration specifications. The cooling chamber 24' of this side-mounted embodiment is seen as also comprising an elongated receptacle (such as, but not limited to, a trough 106') and a fluidizing assembly (not shown), but similar to that assembly 108 of FIG. 1B). It should be apparent to one reading this disclosure that the component system of the fluidizing assembly 108 shown in FIG. 1B, including the blower 110, conduits 112, headers 114 and subheader assembly 116, is integrated with the trough 106' as shown in FIG. 6 and operated as described earlier. Depicted in FIG. 6 is also the hopper 120 and outlet duct 118 by which the cooling chamber 24' communicates with the hopper 120 to discharge cooled sand from the cool fluidized bed 34' in a manner similar to that described above with respect to the embodiments of FIGS. 1A and 1B. The hopper 120 discharges the cooled sand to a device such as, but not limited to, a pneumatic transporter. As mentioned with respect to the embodiments of FIG. 1, a cooling loop 124 is preferably incorporated within the cooling chamber 24'. A basic classifying (ventilation) hood 134' is seen as covering the cooling chamber 24', and functions to remove fines and to draw hot fluidizing medium from the cooling chamber and also from the hopper 120 as previously described with respect to FIG. 1. The fines are separated from the fluidizing medium at a cyclone (not shown) and, preferably, hot fluidizing medium is returned to the fluidizing assembly 68' (FIG. 1B) associated with the heating chamber 22', also, as previously described with respect to FIG. 1. The embodiment of FIG. 6 is depicted as having a heat exchanger 180 positioned within the hottest zones of the cooling chamber 24' to take advantage of secondary heat reclamation, which reclaimed heat is re-used within the furnace system 20 or, alternately, used elsewhere (such heat exchange being acceptably used also in the embodiments of FIG. 1). Reference to FIG. 7 shows, in schematic representation, a serpentine flow path which is one of numerous alternate flow paths acceptably used in connection with the various embodiments of the present invention. In accordance with this serpentine flow embodiment, baffle walls 182 channel the sand 30 along the chosen path.

While the embodiments which have been disclosed herein are the preferred forms, other embodiments will suggest themselves to persons skilled in the art in view of this disclosure. Any relationships and dimensions shown on the drawings are given as the preferred relative relationships, but the scope of this disclosure is not to be limited thereby.

I claim:

1. A method for processing a casting having a sand core and reclaiming sand from the sand core, the sand core comprising sand particles bound together by a binder material, the sane core defining a cavity within the casting, and the method comprising the steps of:

containing the casting, with at least a portion of the sand core therein, in a chamber within a furnace system;

heating the chamber to a temperature sufficient to loosen a portion of the sand core such that portions of the sand core are loosened from the cavity and exit the casting while the casting is within the furnace system, subjecting portions of the sand core that exit the casting within the chamber to a first fluidizing step, while heating the binder material of said portions and reclaiming sand therefrom;

discharging the reclaimed and fluidized sand from the chamber into a cooling chamber of said furnace system;

cooling the reclaimed sand, wherein the cooling step includes the further step of a second fluidizing of the sand within the cooling chamber by gases introduced therein at an introduction temperature, whereby, through a heat transfer between said fluidized sand and said gases, said gases are heated within said cooling. chamber to a temperature above said introduction temperature; and, collecting the heated gases from the cooling chamber and utilizing the heated gases in said first fluidizing step.

2. The method of claim 1, wherein the heating step further comprises the step of heating the chamber to a temperature sufficient to heat treat the casting.

3. The method of claim 1, wherein the heating step further comprises the step of heating the chamber to a temperature sufficient to combust a combustible binder material acting as the binder material of the sand core.

4. The method of claim 1, wherein the step of discharging further comprises the step of causing said sand to flow toward and over a weir to discharge sand from the chamber.

5. The method of claim 1, wherein the chamber and the cooling chamber are proximately located such that heat passes between the chamber and the cooling chamber.

6. The method of claim 1, wherein the collecting step includes a step of separating fines from the reclaimed sand.

7. A method for processing a casting having a sand core and reclaiming sand from the sand core, the sand core comprising sand particles bound together by a binder material, the sand core defining a cavity within the casting, and the method comprising steps of:

introducing the casting, with at least a portion of the sand core therein, into a furnace system, wherein the furnace system defines a heating region, and a cooling region disposed below and proximate to the heating region and in heat and gaseous communication with the heating region, and wherein the heating region includes at least a floor and a weir defining a weir opening edge positioned above the floor;

heating the core material in the casting while the casting is disposed within the heat region to a temperature sufficient to loosen sand core material from the casting, wherein portions of the sand core exit from the casting into the heating region;

reclaiming, at least partially and within the heating region, sand from the portions of the sand core that have exited the casting;

directing a flow of reclaimed sand over the weir opening edge so that reclaimed sand falls from the weir into the cooling region;

cooling the reclaimed sand in the cooling region; and discharging the reclaimed sand from the cooling region.

8. The method of claim 7, further comprising the step of heat treating the casting within the heating region.

9. The method of claim 8, wherein the heat treating step is accomplished in an upper area of the heating region and the loosened sand core material falls from the casting to a lower area of the heating region, and the reclaiming step includes the step of fluidizing core material in the lower area.

10. The method of claim 7, further comprising a step of removing fines from the furnace system.

11. The method of claim 7, further comprising a step of removing fines from the sand within the cooling region.

12. The method of claim 7, wherein the system includes a support assembly for supporting the casting within the heat region, and wherein the introducing step includes a step of placing the casting upon the support assembly.

13. The method of claim 7, wherein the heating step includes a step of combusting binder material of the portion of the sand core to dislodge sand core material from the casting, and wherein the reclaiming step includes a step of fluidizing the portions of sand core that have exited the casting in a manner that facilitates the step of further combusting.

14. The method of claim 13, further comprising a step of withdrawing gasses from the cooling region and utilizing those withdrawn gasses in the fluidizing step of the reclaiming step.

15. The method of claim 14, further comprising a step of removing fines from the sand within the cooling region.

16. The method of claim 15, wherein the step of removing fines includes steps of entraining fines in the gasses drawn from the cooling region and separating the fines from the gasses.

17. A furnace system for processing a casting having sand core material attached thereto and reclaiming sand from the sand core material, the sand core material comprising sand particles bound together by a binder material, the sand core material defining a cavity within the casting, and the furnace system comprising:

a heating work chamber for receiving the casting therewithin;

heating means for heating said heating work chamber to a temperature sufficient to pyrolize binder material of the sand core, whereby portions of the sand core material are loosened and exit from the casting while the casting is within said heating work chamber;

a reclaiming fluidizer within said work chamber for substantially reclaiming sand from portions of the sand core material, and a cooling fluidizer for receiving the reclaimed sand from said reclaiming fluidizer and cooling the reclaimed sand, wherein said cooling fluidizer is proximate to and in heat and gaseous communication with said reclaiming fluidizer.

18. The furnace system of claim 17, wherein said work chamber defines a casting conveyor region and a fluidized region separate from said conveyor region, said reclaiming fluidizer being disposed within said fluidizer region.

19. The furnace system of claim 17, wherein said work chamber defines a fluidizer region and said reclaiming fluidizer is disposed within said fluidizer region, and wherein the furnace system further comprises a conveyor within said fluidizer region of said work chamber, whereby castings are conveyed by the conveyor through the fluidizer region.

20. The furnace system of claim 17, further comprising a conveying means for conveying the reclaimed sand and any attached binder material away from said furnace system.

21. The furnace system of claim 17, wherein said cooling fluidizer is disposed within a cooling work chamber, and wherein said reclaiming fluidizer takes suction from said cooling work chamber.

22. The furnace system of claim 17, further comprising an intake assembly, wherein said reclaiming fluidizer takes suction from said cooling work chamber through said intake assembly, and wherein said intake assembly is operative to remove fines from the cooling work chamber.

23. The furnace system of claim 22, further comprising slats positioned proximate to said intake assembly and operative to deflect particles from said intake assembly.

24. The furnace system of claim 21, wherein said reclaiming fluidizer is disposed within said heating work chamber and said heating work chamber and said cooling work chamber are contiguous.

25. The furnace system of claim 24, wherein said cooling work chamber includes a top and said heating work chamber is mounted to said top of said cooling work chamber.

26. The furnace system of claim 17, further comprising a weir for passing the reclaimed sand from said reclaiming fluidizer to said cooling fluidizer.

27. The furnace system of claim 26, wherein said weir defines a height, and wherein the furnace system further comprises adjustment means for adjusting said height of said weir.

28. A furnace system for processing a casting having sand core material attached thereto and reclaiming sand from the sand core material, the sand core material comprising sand particles bound together by a binder material, the sand core material defining a cavity within the casting, and the furnace system comprising:

a heating work chamber for receiving the casting therewithin;

heating means for heating said heating work chamber to a temperature sufficient to dislodge portions of the sand core material from the casting, whereby portions of the sand core material exit the casting while the casting is within said heating work chamber;

a receptacle for receiving the portions of the sand core material which have exited the casting, said receptacle being in gaseous and heat communication with said heating work chamber, said receptacle including a bottom;

a fluidizer for fluidizing the sand core material within said receptacle to reclaim sand;

a weir conduit defining an elongated passage and including a first end including a weir edge that defines an upper weir opening that is open to said passage, wherein sand flows over said weir edge into said passage to exit said receptacle, and wherein said opening is disposed above said bottom of said receptacle to define a weir height, and a second end, wherein said passage is open at said second end and the sand flows from said second end to exit said receptacle; and adjustment means for adjusting said weir height so that the amount of time that the sand core material is subjected to said fluidizer is adjusted.

29. The furnace system of claim 28, wherein said adjustment means includes an extension connected to said weir conduit and extending above said weir edge.

30. The furnace system of claim 29, wherein said extension is an elongated conduit connected to said weir conduit and extending upward from said weir edge.

31. The furnace system of claim 28, wherein said bottom defines an aperture disposed beneath said weir edge, and wherein said aperture and said weir are constructed so that the sand flows through said aperture subsequent to flowing over said weir edge.

32. The furnace system of claim 31, wherein said adjustment means includes an adjustable connection between said weir conduit and said bottom.

33. The furnace system of claim 31, wherein said weir extends through said aperture and includes an upper end disposed above said aperture and a lower end disposed beneath said aperture such that said bottom extends substantially around said weir, wherein said weir is movably associated with said bottom such that said upper end is capable moving between a first position in which said upper end is a first height above said bottom and a second position in which said upper end is a second height above said bottom.

34. The furnace system of claim 33, wherein said adjustment means includes a flange connected to said bottom and cooperating with said weir to maintain said weir alternatively in said first height and said second height.

35. The furnace system of claim 34, wherein said flange includes a first aperture, wherein said weir defines a second aperture, and wherein said adjustment means includes a pin for removably inserting into said first aperture and said second aperture to maintain said weir at said first height.

36. The furnace system of claim 35, wherein said wall of said weir defines a third aperture, wherein said pin is further for removably inserting into said first aperture and said third aperture to maintain said weir at said second height.

37. A method for processing a casting having a sand core and reclaiming sand from the sand core, the sand core comprising sand particles bound together by a binder material, the sand core defining a cavity within the casting, and the method comprising the steps of:

containing the casting, with a least a portion of the sand core therein, in a furnace chamber heated to a temperature sufficient to loosen portions of said core from the casting, whereby portions of the sand core are loosened and exit the cavity of the casting while the casting is within the furnace;

subjecting portions of the sand core which have exited the casting to a fluidizing step in a fluidizing bed, wherein the fluidizing step includes the steps of separating binder material from sand of the portions of the sand core that have exited the casting, whereby sand is reclaimed from the portions of sand core, and causing sand to flow toward and over a weir to discharge reclaimed sand from the furnace chamber; and changing the height of the weir so that the size of the fluidized bed is changed and the amount of time that the collected portions of sand core are subjected to the fluidizing step is changed.

38. The method of claim 37, further comprising the step of heating the furnace chamber to a temperature sufficient to combust a combustible binder material acting as the binder material of the sand core.

39. The method of claim 37, further comprising the step of heating the furnace chamber to a temperature sufficient to heat treat the casting.

40. The method of claim 37, further comprising the step of heating treating the casting within the heating region.

41. The method of claim 40, wherein the heat treating step is accomplished in an upper area of the furnace chamber and the loosened sand core material falls from the casting to a lower area of the furnace chamber, and the fluidizing step includes the step of fluidizing core material in the lower area.

42. A furnace system for processing a casting having sand core material attached thereto and reclaiming sand from the sand core material, the sand core material comprising sand particles bound together by a binder material, the sand core material defining a cavity within the casting, and the furnace system comprising:

a heating work chamber for receiving the casting therewithin;

a heater for heating said heating work chamber to a temperature sufficient to dislodge portions of the sand core from the casting, whereby portions of the sand core material exit the casting while the casting is within said heating work chamber;

a reclaiming fluidizer for receiving the portions of the sand core material that exit the casting and substantially reclaiming sand from the portions of the sand core material, wherein said reclaiming fluidizer is proximate to and in heat and gaseous communication with said heating work chamber; and a cooling fluidizer for receiving the reclaimed sand from said reclaiming fluidizer and cooling the reclaimed sand, wherein said reclaiming fluidizer is operative to draw heated gasses from proximate to said cooling fluidizer and use the heated gasses in the reclaiming of sand from the fallen portions of the sand core.

43. The furnace system of claim 42, further comprising an intake assembly proximate to said cooling fluidizer, wherein said reclaiming fluidizer is operative to draw the heated gasses from proximate to said cooling fluidizer through said intake assembly, and wherein said intake assembly is operative to remove fines from proximate to the cooling fluidizer.

44. The furnace system of claim 43, further comprising slats positioned proximate to said intake assembly and operative to deflect particles from said intake assembly.

45. The furnace system of claim 42, wherein said reclaiming fluidizer is disposed within said heating work chamber.

46. The furnace system of claim 42, further comprising a conveyor disposed in an upper area of said heating work chamber, wherein said reclaiming fluidizer includes a bed of fluidizing medium disposed in a lower area of said work chamber.

47. A method for processing a casting having a sand core and reclaiming sand from the sand core, the sand core comprising sand particles bound together by a binder material, the sand core defining a cavity within the casting, and the method comprising steps of:

introducing the casting, with at least a portion of the sand core therein, into a furnace system, wherein the furnace system defines a heating region, and a cooling region in heat and gaseous communication with the heating region, and wherein the heating region includes at least a floor and a weir defining a weir opening positioned above the floor;

heating the core material in the casting while the casting is disposed within the heat region to a temperature sufficient to both heat treat the casting and loosen sand core material from the casting, wherein portions of the sand core exit from the casting into the heating region;

reclaiming, at least partially and within the heating region, sand from the portions of the sand core that have exited the casting;

discharging the reclaimed sand through the weir opening from the heating region into the cooling region;

cooling the reclaimed sand in the cooling region; and discharging the reclaimed sand from the cooling region.

48. The method of claim 47, further comprising a step of removing fines from the furnace system.

49. The method of claim 47, further comprising a step of removing fines from the sand within the cooling region.

* * * * *